US011224548B2

(12) United States Patent
Depauw

(10) Patent No.: US 11,224,548 B2
(45) Date of Patent: Jan. 18, 2022

(54) SYSTEM AND METHOD FOR ROTATING A PATIENT

(71) Applicant: ERGOTRICS N.V., Hoogstraten (BE)

(72) Inventor: Paul Richard Alfons Maria Depauw, Hoogstraten (BE)

(73) Assignee: ERGOTRICS N.V., Hoogstraten (BE)

( * ) Notice: Subject to any disclaimer, the term of this patent is extended or adjusted under 35 U.S.C. 154(b) by 23 days.

(21) Appl. No.: 16/330,143

(22) PCT Filed: Sep. 4, 2017

(86) PCT No.: PCT/IB2017/055306

§ 371 (c)(1),
(2) Date: Mar. 4, 2019

(87) PCT Pub. No.: WO2018/042396

PCT Pub. Date: Mar. 8, 2018

(65) Prior Publication Data

US 2019/0201263 A1 Jul. 4, 2019

(30) Foreign Application Priority Data

Sep. 5, 2016 (NL) ..... 2017416

(51) Int. Cl.
*A61G 7/00* (2006.01)
*A61G 7/10* (2006.01)

(52) U.S. Cl.
CPC ..... *A61G 7/001* (2013.01); *A61G 7/103* (2013.01); *A61G 7/1036* (2013.01); *A61G 7/1021* (2013.01); *A61G 7/1038* (2013.01)

(58) Field of Classification Search
CPC ..... A61G 7/001; A61G 7/103; A61G 7/1036; A61G 7/1021; A61G 7/1038
(Continued)

(56) References Cited

U.S. PATENT DOCUMENTS 3,775,781 A 12/1973 Bruno et al.
4,294,240 A * 10/1981 Thill ..... A61F 13/041 602/21

(Continued)

FOREIGN PATENT DOCUMENTS

JP 2012/183312 A 9/2012
WO 2005/122992 A2 12/2005

(Continued)

OTHER PUBLICATIONS

International Search Report for NL2017416 (PCT/IB2017/055306), dated Apr. 5, 2017, pp. 1-10.

*Primary Examiner* — Myles A Throop
(74) *Attorney, Agent, or Firm* — Thomas|Horstemeyer, LLP

(57) ABSTRACT

A patient rotation system for rotating the body of a patient comprises an air inflatable cushion having two elastic exterior surfaces, e.g. of stretch material, wherein one of said two elastic surfaces of said cushion forms the top surface, and the other one forms the bottom surface. In deflated state the cushion has a flat shape and in inflated state the two elastic surfaces bulge away from each other, such that inflation of the cushion causes the cushion to assume a wedge shape thereby rotating the body around said rotation axis. The cushion is embodied as a unitary, semi-rigid, portable board when in its deflated state, which enables the sliding of the deflated cushion in between the body of the patient and a horizontal surface, on which the body is lying in supine position, until its posterior support points are being supported by the cushion at its top elastic surface.

20 Claims, 5 Drawing Sheets

(58) Field of Classification Search
USPC ..... 5/607
See application file for complete search history.

(56) References Cited

U.S. PATENT DOCUMENTS 4,686,719 A * 8/1987 Johnson ..... A61G 7/1021 180/125
4,700,416 A * 10/1987 Johansson ..... A61G 7/103 5/81.1 T
4,977,629 A 12/1990 Jones
5,570,482 A * 11/1996 Asakawa ..... A61G 7/1015 5/81.1 C
5,774,917 A 7/1998 Liu
5,970,550 A 10/1999 Gazes
6,374,435 B1 * 4/2002 Leininger ..... A61G 7/1026 5/81.1 C
6,675,411 B1 * 1/2004 Javier ..... A61G 7/1032 5/81.1 HS
6,966,081 B1 * 11/2005 Sharps ..... A61G 7/1046 5/621
7,120,952 B1 * 10/2006 Bass ..... A47C 27/006 5/484
7,681,269 B2 3/2010 Biggie et al.
9,320,667 B2 * 4/2016 Tilk ..... A61G 7/1036
9,675,509 B2 * 6/2017 Tilk ..... B65D 33/065
2009/0045383 A1 * 2/2009 King ..... A61G 7/10 254/93 HP
2009/0106893 A1 * 4/2009 Blevins ..... A61G 7/001 5/81.1 RP
2012/0284923 A1 * 11/2012 Jensen ..... A61G 1/04 5/627
2015/0007832 A1 * 1/2015 Jensen ..... A61G 1/013 128/870
2017/0326011 A1 * 11/2017 Alvarez ..... A61G 7/1026
2018/0280219 A1 * 10/2018 Garrett ..... A61G 7/05776

FOREIGN PATENT DOCUMENTS

WO WO-2011064796 A1 * 6/2011 ..... A61G 7/1026
WO 2013/166003 A1 11/2013

* cited by examiner

SYSTEM AND METHOD FOR ROTATING A PATIENT

CROSS-REFERENCE TO RELATED APPLICATIONS

This application is the National Stage of International Application No. PCT/IB2017/055306, filed Sep. 4, 2017, which claims the priority to NL 2017416, filed Sep. 5, 2016, which are entirely incorporated herein by reference.

TECHNICAL FIELD

The present invention pertains to a system and method for sideway rotating the body of a patient, which is laying on a horizontal surface, e.g. prior to or after spinal surgery.

BACKGROUND

Medical procedures regularly require rotating the body of a patient laying in a supine position into a prone position, and vice versa, while the patient is unconscious or in another way unable to move by itself.

In particular, medical protocols such as treatments, diagnostic methods or surgery on the neck or spine require a patient to assume a prone position while anaesthetized, while operations in order to prepare the body of the patient for surgery, e.g. anaesthetization, intubation, or the attachment of medical equipment onto the anterior part of the body, require a supine position. These preparations are to be made generally while the patient is laying on a (moveable) hospital bed, stretcher, gurney, litter or similar device, while the actual medical protocol is performed while the body is on e.g. an operating table. Prior to, and after performing the medical protocol, the bed is placed alongside the operating table, and the unconscious body of the patient needs to be moved as well as rotated between these two positions.

Other procedures requiring patients to be rotated sideways in switching between these positions, either or not involving different surfaces, include nursing protocols for disabled, bed-ridden patients.

Common hospital beds only have a mattress and lack any equipment to facilitate this transfer of a patient onto an operating table, in particular lack equipment facilitating the rotation of the body of the patient. Therefore this transfer has to be done fully manually in practice. Generally a team of six or even more health care workers are required to accomplish such rotation and transfer of a patient and still the rotation is often performed not so gentle. In general this transfer is perceived as being a physically demanding and time consuming operation, which in the operating room brings along two major disadvantages.

Firstly, the necessity for this amount of manpower is unfavorable, given that the rest of the procedure, and other procedures simultaneously taking place in the operating room, are commonly performed in much smaller teams, e.g. of three people,—such that the mobilization of the extra assistance often causes unduly long waiting times and delays for the surgeon and the other team members. Secondly, the operation being time consuming leads to the gathered team members being temporarily unavailable to perform other, own duties.

Various inflatable devices are commercially available to assist in the sideway rotation of laying patients, aiming at reducing the manpower and time required for the operation, with a number of patents disclosing devices of that nature, in the form of balloons, pads, cushions or mattresses.

For instance, U.S. Pat. No. 3,775,781 discloses a patient turning apparatus having an air mattress which is to be placed on top of the nursing bed. It comprises identical right and left parts, on which the patient is laying in the center, and wherein inflation of either part leads to its rotation to the left or right side, respectively.

The patent application US2009/0106893 discloses an inflatable air mattress for rotating patients, which is to be placed on top of a conventional mattress. It comprises equal right and left chambers, onto one of which the patient is laying, such that the patient can be rotated over a 90° arc of motion, after which the further rotation onto the other chamber can be achieved manually.

The patent application WO2005/122992 particularly discloses a system for transporting and positioning the patient laying in a supine position on a movable transportation device onto an operating table in prone position, wherein the transportation device is located immediately laterally of the operating table.

Other prior art is found in JP2012/183312, U.S. Pat. Nos. 4,977,629, 5,774,917, 5,970,550 and 7,681,269.

Whereas each of the devices and/or methods disclosed therein suit their intended purpose, none of these has been able to preclude the requirement for the patient to assume its laying position, from which it is to be rotated, after the device has been positioned onto the surface first. That is, in case it has to be rotated from a bed, the device has to be placed on top of the mattress first, after which the patient can be positioned on top of it. If the patient is already on the surface the device is to be placed on prior to the positioning of the device thereon, this means that the subsequent positioning of the patient onto the device requires the patient to be displaced, at least vertically, from this surface by external, generally manual, force, so that it can be used for assisting in the rotation.

The incapability of the known devices to enable positioning of the patient onto the turning device after it has assumed its laying position on a surface, causes these to be inapplicable for rotating patients in the operating room. Given that a patient who often has mobile dysfunctions, and is about to undergo a procedure there on his spine or neck has prior to their transportation to the location of the procedure are already been laid down in a moveable nursing bed, most of the times with medical equipment already even being attached to their body in preparation to the procedure, this incapability is an insurmountable shortcoming for application in this context.

SUMMARY

The present invention aims to provide an improved system for sideway rotating a patient in a lying position, and a method for applying the system to rotate a patient in a lying position.

A first object of the invention is to provide a system and method that reduce the manpower needed to accomplish the rotation with respect thereto, e.g. to a practical number of at most three team members—which results in a reduction, or elimination, of the waiting times and delays involved with the mobilization of health care workers.

A second object of the invention is to provide a system and method that improve the speed with which the transfer operation can be performed, such that potentially gathered extra team members are available again to return to other duties quickly after being called away to assist in the rotation operation.

The invention proposes a system for rotating the body of a patient around a rotation axis. The body can be lying on a horizontal surface, e.g. a bed, having posterior support points that are formed by the points on the posterior surface thereof that are located under the hips and shoulder blades. The rotation axis can be defined by the hip joint and shoulder joint at a common lateral side of the body of the patient. The system can be characterized in that the cushion comprised thereby is embodied as a unitary, semi-rigid, portable board when in its deflated state, which enables the sliding of the deflated cushion in between the body of the patient and said horizontal surface, on which said body is lying in supine position, until its posterior support points are being supported by the cushion at its top elastic surface, said deflated cushion preferably having a rigidity so as to allow for the exertion of a pushing force on one of its multiple edges during the sliding of the cushion in between the body of the patient and said horizontal surface.

The invention is based on the insight that sliding of the deflated cushion in between the body of the patient and the surface the patient is lying on enables it to be positioned under the patient while using manual force to displace particularly the cushion, rather than the body of the patient. That is, to achieve a positioning wherein the inflation of the cushion leads to, or facilitates, the desired rotation of the patient, without any horizontal displacement of the patient, or any vertical displacement thereof that is larger than the thickness of the cushion in deflated state, to be required therefore, after the lying position has been assumed by the patient.

Embodying said system according to the characterizing element thereof facilitates said sliding, which enables the use of the known principle of inflation to achieve a sideway rotation of a patient in the discussed context specifically in the operating room, in particular prior to and after medical protocols on the neck or spine. Thereby it aims to solve the before mentioned two major disadvantages the original, manual way of operating to achieve the rotation of patients in the operating room brings along.

The invention is envisaged to be used to rotate, or assist the rotation of, the body of a patient that is initially lying on a horizontal surface, which is in the operating room generally formed by the top surface of the mattress on a wheeled nursing or hospital bed, on which the patient is transported from and to the location where the medical protocol takes place. More occasionally, it can however for instance be a stretcher, gurney, litter or similar transportation device as well. The system is adapted to facilitate a rotation of the body around the hip and shoulder joint at a common lateral side of the body, that is, around the left hip and shoulder, or the right hip and shoulder.

The air inflatable cushion has two elastic exterior surfaces, which are circumferentially joined together to form multiple edges that extend over their common circumference. In an embodiment these elastic exterior surfaces are airtight, so that these surfaces define the air inflatable volume. In another embodiment one or more airtight inflatable balloons or bladders forming the inflatable volume are received in the space between the elastic exterior surfaces whereby the latter need not be airtight.

Firstly, the ability of the elastic surfaces to be substantially parallel to each other when deflated, makes that the cushion has a flat shape in this state, such to enable the design of embodiments in a board-like form. Secondly, the common edges over the circumference make that its parts remain connected over the contour, and thereby that the cushion can be handled as a single unit in both the inflated and deflated state.

In an embodiment the elastic surfaces have a mutual spacing, even in deflated state, wherein the cushion is provided with additional stability by the presence of one or more spacer layers, or spacer elements, in between them. Preferably said one or more spacer layers and/or spacer elements are elastically compressible in plan view of the cushion.

While enabling characterizing embodiments, the system accomplishes effectuation of a rotation of the complete body by comprising the described cushion, and providing it with the described dimensioning.

The cushion assuming a wedge shape over the edges in response to the surfaces to have an elasticity that allows them to bulge away from each other upon inflation as the common circumference of the cushion remain in place, enable the tilt angle of the body with the horizontal surface to correspond to the mutual angle between the surfaces that is created over an edge that is positioned proximal to the rotation axis. The contact area of the body and the cushion remaining as large as possible during inflation in this manner, makes for the inflated air to effectively and controllably result in rotation of the body.

It is in the case of a rotation in supine position of the patient, required for rotational forces to at least apply to the posterior support points of the body, that is, the points on the back surface of the patient that together support the majority of the weight of the body in in this position. These posterior support points are in this position located on the posterior surface underneath the hips and shoulder blades. This means that tilting the points of the back surface at the height of the hips and shoulder blades effectively results in the rotation of the whole body. Having the elastic surfaces of the system be dimensioned such to enable support of these points of the body, is therefore in function of the capability of the system to effectuate a rotation of the desired nature.

In an embodiment the inflatable volume has an upper portion adapted to support a thoracic and shoulder region of the body, a central portion adapted to support the abdominal region of the body, and a lower portion adapted to the pelvic region of the body. Herein upper, central, and lower, refer to the direction from head to toes. In an embodiment it is envisaged that the cushion does not support the head and legs of the body.

In a preferred embodiment the inflatable volume is a single inflatable volume forming said upper, central, and lower portions, preferably—in inflated state—said upper and lower portions each having a greater cross-section in a lateral plane than said central portion of the inflatable volume adapted to support said abdominal area. This focuses the support and rotation effect on the shoulder/thoracic region and on the pelvic region. It also reduces the quantity of air needed for inflation.

In this embodiment, both the upper portion and the lower portion substantially have the shape of a circle in a plan view of the cushion, which are substantially positioned in-line with each other in the longitudinal direction, and are interconnected by the central area. Therein, segments of the outer circumference of the circle-shaped upper and lower portion may substantially a part of the common circumference of the cushion, whereas the circumference of the central portion may define the remaining part of the common circumference, so to connect said segments.

In a preferred embodiment, longitudinally in-line circles enclosing an as large as possible area of the elastic surface are inscribed in at least one of the elastic surfaces, in order to control the amount of air required for complete inflation of the cushion, and determine the height of the cushion in its inflated state. Preferably, therein an as large as possible segment of each circle-shaped inscription runs closely along the common circumference of the cushion, e.g. the cushion comprising said upper, central and lower portion of which the upper and lower portion each substantially define a circle, that is only slightly larger than the inscribed circle it encloses.

In an embodiment the inflatable volume has an upper portion adapted to support a thoracic and shoulder region of the body, a central portion adapted to support the abdominal region of the body, and a lower portion adapted to the pelvic region of the body, wherein—seen in plan view onto the cushion—along at least one longitudinal edge of the cushion each of said upper, central, and lower portions of the inflatable volume defines a section of a turning edge, wherein said turning edge section of the central portion is indented or offset towards a center line of the cushion relative to said turning edge sections of said upper and lower portions of the inflatable volume. As explained in more detail below, this design feature may contribute to controlled rotation in direction towards said indent.

In a possible embodiment, the elastic surfaces are made out of, or comprise, a stretch material, preferably a stretch textile, e.g. covered by an elastic plastic layer, e.g. an elastic polyurethane layer.

In a preferred embodiment, the elastic surfaces are made out of, or comprise, PU-coated PA tissue, which is a tissue out of polyamide with a polyurethane coating or finish. PU-coated PA tissue is an example of a flexible, non-stretch material that can be used to form the elastic surfaces. In this embodiment, the elastic surfaces are for example creased to some extent in at least a (partly) inflated state of the cushion. In alternative embodiments the elastic surfaces are made out of, or comprise, an uncoated, warp-knitted material, for example tricot, and/or a non-woven material wherein said creasing behavior may be encountered as well. The material of the threads may, for instance, be cotton, flax, and/or an aramide, for instance kevlar.

Possibilities for the shape of the cushion in the plane of the elastic surfaces, that allow for the support of the posterior support points of the body when positioned thereunder, are many. Simple examples, of which plenty of variants can be thought of, are a (rounded) rectangle, a (rounded) trapezium, a rectangle extended by half circles at each side.

The dimensioning of the cushion should at least enable the support of the posterior support points of the body when positioned thereunder. Preferably, the size is such that it is suitable to fit an as wide as possible range of body dimensions, in that it is capable of supporting the posterior support points thereof when positioned thereunder, while the portability of the cushion is preserved. In particular, based on anthropometric data for body dimensions, its extension in the longitudinal dimension of the patient when positioned thereunder, should preferably an as wide as possible range of upper body lengths, and the extension of the cushion in the lateral dimension of the patient an as wide as possible range of shoulder widths, while preserving portability as much as possible. In the most preferred compromise between the suitability of the cushion to body dimensions and the portability, its longitudinal extension fits 99% of the upper body lengths of males, which corresponds to 997 mm, and the lateral extension 99% of shoulder widths in males, which corresponds to 500 mm. For example the cushion has a length of between 0.9 and 1.1 meter and a width of between 0.45 and 0.60 meter.

In order for the cushion to rotate the patient lying thereon in the right direction while providing support to its posterior support points, a further function of the cushion is to determine the direction of the rotation upon inflation. With the curvature of the elastic surfaces already being determined by the elasticity of the surfaces and the edges being joined, the proposed mechanism to create the tendency for the body to rotate to the right side is to have the top of the curvature positioned slightly to the side of the longitudinal midline of the body, away from the intended rotation axis. Upon inflation, the body consequently experiences a relative misbalance towards the intended side of rotation, such that it hinges over the top of the curvature of the elastic surfaces, thereby rotating in the intended direction.

In a proposed system, this mechanism is embodied by an asymmetry in the lateral direction of the cushion, such that one side thereof has a larger surface area that encloses the inflatable volume than the other with respect to the center of the lateral extension—or: width. In possible embodiments of the cushion, many different forms are thinkable for this asymmetry. In one example a longitudinal edge at the side thereof opposite to the rotation axis when underneath a patient is bent outwards, that is, away from the center of the cushion. In another example, the a longitudinal edge at the side that is to be placed near the rotation axis is laterally bent inwards towards the center of the cushion, or in another, the elastic surfaces are joined together to form a non-inflatable part of the elastic surfaces in between the outer edges, for instance in the form of a rectangle, or half circle.

More preferably however, in favor of the portability of the cushion, in contribution of which the maximum longitudinal and lateral dimensions of the cushion are minimized, the asymmetry is provided in the form of a small area of the elastic surface being locally joined together to form an extra set of edges in between the outer edges of the cushion, at the side that is to be positioned under the patient near the rotation axis. This area can take a variety of forms, for instance a rectangle, half circle, or trapezium.

The effectiveness of the small joined together area in terms of the extent to which it shifts the top of the curved surfaces away from the midline of the body, and thus the amount of misbalance created, increases as it is provided more proximal to the rotation axis.

In a proposed system, the asymmetry is therefore embodied by an indent of the longitudinal edge of the cushion that is to be placed proximal to the rotation axis when underneath a patient. That is, the edge is locally bent inwards laterally, towards the center of the cushion. Again, the so created cut-away can take many forms, but most preferably its longitudinal dimension increases in lateral direction in favor of the effectiveness. Possibilities are a half circle, a (rounded) trapezium, or a (rounded) triangle.

During sliding in between the body of the patient and the horizontal surface, the semi-rigidity of the cushion creates the resistance of the cushion to in-plane forces induced by the bodyweight of the patient pressing into the horizontal surface, which counteract the introduction of the cushion in between both surfaces, resulting in the deformation thereof in the plane of the elastic surfaces, or in the elastic surfaces to shear relative to one another. During positioning of the cushion relative to the body of the patient, and during transportation, the semi-rigidity makes the cushion move as a unity in response to localized exertion of manual forces.

Thereby the user is enabled to responsively control the movements of the complete cushion while holding on to it at any (small) part of it.

The semi-rigid embodiment of the cushion is achieved by having it comprise one or more elements that provide it with this property, e.g. a semi-rigid or rigid spacer material in between the two elastic surfaces or a semi-rigid or rigid frame, e.g. connected to the multiple edges of the cushion, provided in a way such to make the unity of the cushion behave as a semi-rigid board, and preferably, in a way such to add as less weight and size to the cushion as possible, in view of the portability. Most preferably, the element(s) are furthermore provided such that the semi-rigid properties are as much as possible uniformly distributed over its volume.

In a proposed system, the cushion has a spacer material in the interior thereof define the spacing that is between the two elastic surfaces in the deflated state, of which the material properties contribute to the semi-rigidity. The material can be provided in one or more layers. Preferably, this spacer material has the form of a spacer-fabric layer. Spacer-fabric layers are sometimes employed in mattresses.

With the spacer material defining the interior of the cushion, its properties contributing to the functioning of the cushion as much as possible is obviously preferred. Two systems are proposed in which the spacer material works in favor of its application by its properties.

Firstly, with the spacer material defining the interior of the cushion in deflated state, its elastic properties also influence the comfort of the patient that is lying on the cushion. Particularly, the extent to which it makes the cushion compressible over the thickness, influences the contact area between the top elastic surface and the back surface of the body (in case it is lying on the cushion in supine position), or the front surface thereof (in case of a prone position).

A compressibility of the cushion is preferred, as it results in a larger contact area, so that the pressure resulting from the bodyweight of the patient is distributed over a larger area of the back, or front surface of the body, which generally leads to more comfort. Having the patient lying comfortably, that is, compromising as less as possible on the comfort relative to lying on a conventional mattress, is much appreciated, as this contributes to the quality of the procedure, both while the patient is conscious and unconscious. It prevents the potential urge for the patient to move in order to solve discomforts, and reduces the risk for injuries after the procedure as a consequence of discomforts.

Furthermore, a larger contact area contributes to the stability and grip of the body onto the device, which reduces the chance for potential corrective repositioning of the body to be necessary due to the impact of operations on the patient, for instance in preparation of the surgery, and during rotation, both effects of which are much appreciated as well.

In a further proposed system, the spacer material is elastically compressible in the direction perpendicular to the plane of the elastic surfaces, that is, over the thickness of the cushion, such that, as preferred, the cushion is compressible and that pressure resulting from the weight of the body of the patient being supported by the cushion is distributed over a contact area in between the top surface of the cushion and the body of the patient.

Secondly, with the spacer material defining the interior of the cushion in deflated state, contributing to semi-rigidity and comfort in this state, it makes up part of the volume enclosed by the elastic surfaces in inflated state as well. Preferably in this state, the spacer material enables, more preferably favors, a fast inflation and a fast return to the deflated state after inflation has stopped.

In a further proposed system therefore, layers of spacer material are connected to the internal surfaces of the elastic surfaces, e.g. by glue, e.g. so that the layers completely cover the surfaces internally.

In a preferred embodiment, the layers of spacer material are each made out of elastically stretchable spacer fabric, which allows the connected layers and elastic surfaces to stretch together. In this way, the spacer material enables a fast inflation of the inflatable volume.

For example the spacer fabric is a 3-D spacer fabric comprising spaced apart upper and lower sheets, e.g. made from a woven or knitted textile material, e.g. polyester material, connected and held apart by spacer yarns, e.g. microfilaments, e.g. polyester microfilaments.

For example a layer of 3D-spacer fabric has a thickness of between 1 and 3 centimeters in non-compressed condition.

The spacer material may for example also be a polyethylene foam (PE-foam) which, even as the spacer fabric, allows the connected layers and elastic surfaces to stretch together—so to enable a fast inflation of the inflatable volume. The density of the PE-foam may be in the range of 24 $kg/m^3$ to 144 $kg/m^3$, preferably 29 $kg/m^3$ to 35 $kg/m^3$.

For example the spacer material is porous or open-pored so as to permeable, e.g. allowing airflow through the spacer material.

In a further preferred embodiment, the layers of spacer fabric or PE-foam are also configured to cause the tendency for the two elastic surfaces to move towards each other, so that the tendency is created for the cushion to return to its deflated state, e.g. so that the cushion is able to self-deflate, e.g. immediately after inflation is stopped. Thereby, the spacer material enables a fast return to the deflated state after inflation has stopped, with no further manual action being required.

An example of a possible alternative spacer material is felt.

When provided, the spacer material is envisaged to limit the lifetime of the system. Preferably, obviously, this lifetime enables as much consecutive uses of the system as possible, such that the reduction of manpower through using it instead of rotating patients manually in the operating room is maximal, so to thereby achieve maximum savings on the availability of medical personnel relative to the system cost.

In a further proposed system, the cushion is embodied to be inflated to its maximum, and to return back to the deflated state from there, for at least 50 times before failure. This failure can for instance be in the form of loss of shape, and/or the ability to self-deflate, so that at least the mentioned use is possible until undue loss of elastic property of the spacer material occurs.

In an embodiment the system is provided with a counter device that counts the number of times that the cushion is inflated, e.g. a sensor combined with a pressure relief valve or an outlet valve that opens upon complete inflation or deflation of the cushion, or a sensor that senses when the cushion is connected to an air supply hose. Or a sensor that senses the stretching of a portion of the cushion representing the cushion being inflated. The counter device may display the number, or transmit the number to a remote device.

This embodiment may in particular comprise a display that, after a predetermined maximum number of times that the cushion is inflated, as counted by the counter device, indicates that the cushion needs to be replaced, so as to encourage the user to replace it.

In an embodiment, the cushion is provided with a Tesla valve, as described in U.S. Pat. No. 1,329,559, for inflating and deflating the cushion. In particular, this valve is provided such that the preferential direction of air flow through the valve is into the cushion, so to offer virtually no resistance is during inflation of the cushion, and constitute a barrier in the direction of air flow out of the cushion. In this way, inflation is allowed to take place easily, and thus fast, while deflation is only allowed to take place slowly. This effect works in favor of the comfort of the patient being laid down on the cushion, and the ease of use.

Next to providing elements to the internal of the cushion, contributions to the semi-rigidity thereof when in deflated state can be provided externally from the elastic surfaces. Preferably, to extend the size of the cushion as less as possible by the provision of such elements, while preserving the properties of the inflatable part, the external elements are preferably provided at the outer edges of the cushion in the plane of the elastic surfaces. More preferably, in favor of the uniformity of the semi-rigid behavior of the cushion, the contribution to the semi-rigid properties thereof as provided by the external elements is as much as possible distributed over the outer edges.

In a proposed system, the cushion is provided with a rigid, or semi-rigid frame, that forms an outer contour of the cushion in the plane of the elastic surfaces, for instance forming its edges thereby. By contributing to the semi-rigidity of the cushion in deflated state, it enhances the sliding thereof in between the patient and the horizontal surface it is lying on.

Besides contributing to the semi-rigidity of the cushion, the provision of the semi-rigid frame also provides an opportunity to improve the operability of the system, given that the contours of the cushion generally form the points of application for manually exerted forces thereon, in order to position, carry, and slide it, such that the manual controllability of the cushion can be enhanced by facilitating the convenient exertion of manual forces thereon during these operations. Preferably, embodiments thereto take up minimal space and weight, in order to minimally compromise on portability. More preferably, they are in the form of cutaways of material. In further preference, the features enable the improved operability by a single user, and suits the points of application a single user would apply during the mentioned operations.

In a further proposed system, the frame is provided with one or more handles, e.g. one or more openings that form handles, e.g. two hand grip openings with an I shape that fits a hand along a longitudinal edge of the cushion, e.g. the edge that is opposite to the longitudinally extending edge that is to be placed near the rotation axis, e.g. mutually spaced apart by 0.5 m to 0.8 m. In this way, the handles would facilitate the gripping and holding on to the cushion by the two hands of a single user, while sliding the cushion, but during transport, positioning and other handling as well, without compromising on material use or size.

In a proposed system, upon inflation, one of the elastic surfaces bulges away from the other of the elastic surfaces such that it bulges away further from a plane defined by the multiple edges extending over the common circumference of the elastic surfaces than the other of the elastic surfaces, e.g. wherein at the common circumference, its absolute angle with said plane is smaller than that of the other of the elastic surfaces with this same plane.

In an example embodiment, wherein layers of spacer material are connected to the internal surfaces of the elastic surfaces, the layer(s) connected to the one of the elastic surfaces are more stiff than the layer(s) connected to the other of the elastic surfaces, e.g. is/are made out of a more stiff material and/or has/have a larger thickness.

In an example embodiment, a layer of PVC-foam is connected to the one of the elastic surfaces, e.g. with a thickness of less than 15 mm.

In view of optimizing the lifetime of the system by preventing damage to the most sensitive parts thereof. Given that the usability decreases with in—and deflating, providing a measure that reduces unnecessary or unintended in—and, thereby entailed, deflation as much as possible would be preferred. In particular, the provision of a feature that prevents the cushion to be overinflated, would yield an efficient contribution therein.

In a proposed system, the cushion further comprises a pressure relief valve, e.g. which avoids overpressurization of the cushion, e.g. which automatically releases any amount of air that would result in the air pressure within the inflatable volume exceeding a predetermined value that corresponds to the air pressure in the inflatable volume when the cushion is in its maximum inflated state.

For example the system further comprises an air pump, e.g. a portable air pump, e.g. an electric powered air pump, and/or a reservoir containing pre-pressurized air. This e.g. allows for use of the system independent of a pneumatic supply present in a surgery room.

It will be appreciated that in embodiments another gas may be used instead of air.

According to the first object of the current invention, the system reduces the amount of manpower required to accomplish the sideway rotation of a lying patient, while according to the second object, it reduces the required time to perform the operation. The maximum angle of rotation of the patient the system is capable of achieving, represents a compromise between these two objectives.

In manually rotating a patient from a lying position, the part of the bodyweight that has to be displaced vertically by human muscle power to have it hinge over the rotation axis of the body, decreases as the angle of the body with the horizontal surface increases. The required support decreases by 50% in the first 30°, and by another 20%, 17%, 10% and 3% for each further increase of the rotation angle by 15°. The contribution of the system of the current invention to the amount of manpower saved for achieving the rotation by having the proposed system of the invention provide the vertical support, decreases accordingly with the rotation angle.

On the other hand, when the patient is rotated by inflation of the cushion, the amount of air that needs to be inflated progressively increases with the rotation angle of the patient to be achieved, and so does the time required to accomplish the rotation to the particular angle.

Preferably therefore, the system provides a good compromise between the range of angles over which it can support the body of a patient, and the inflatable volume at the maximum angle that can be achieved therewith, which determines the amount of air to be inflated therefore. In this way the system can be most effective in terms of the amount of manual effort saved relative to the time necessary for the inflation.

In a most preferred embodiment, the cushion is able to provide this vertical support while the body is being rotated over a range of angles from 0° up to between 45°, corresponding to the system yielding a 70% reduction of the part of the bodyweight to be supported manually upon initiation of a further rotation, and 75°, corresponding to 97% reduction.

In a proposed system, the cushion is dimensioned such that when in maximum inflated state, it supports the body of the patient while it is at an angle of up to 45° to 75° with the horizontal surface.

In a proposed system, the system further comprises a side flap connected to the cushion at a lateral side thereof, which is adapted to support the hip joint and/or the shoulder joint which define(s) the rotation axis at said lateral side, while the body of the patient is being rotated around the rotation axis and/or while lying on the cushion in its inflated state at an angle relative to the horizontal. In this way, the downward force on the side flap exerted by the bodyweight of the patient secures the cushion in place with respect to the body of the patient and/or the surface the cushion is being supported by. Preferably, this flap is flexible and/or compressible over its thickness, so that pressure resulting from the weight of the body of the patient being supported by the cushion is distributed over a contact area in between a top surface of the side flap and the hip and/or shoulder region of the patient. In contribution to the second object of the invention, the optimization of its design in terms of the physical properties of its parts is believed to be most effective when these minimize the resistance of the system to be inflated while providing support to a lying patient, and to be slid under the lying patient.

Preferably therefore, the amount of air to be introduced relative to the rotation angle achieved is minimized by a first measure, and the amount of horizontal force required for sliding the cushion under the lying patient over the required distance, are minimized by a second.

In a proposed system that comprises embodiment of the first measure, the inflatable volume of the cushion in inflated state is minimized by at least minimizing the ratio between the inflatable volume and the surface area of the elastic surfaces of the cushion in inflated state, and/or by minimizing the surface area of the elastic surfaces itself. These minimizations can for instance be achieved by minimizing the length of the edges of the cushion that enclose the inflatable volume, e.g. by providing them with a rounded shape as much as possible, and by minimizing the longitudinal and lateral extension of the elastic surfaces.

In a proposed system that comprises embodiment of the second measure, the surface friction at the interface of the top elastic surface of the cushion and the body of the patient, and at the interface between the bottom elastic surface of the cushion and the horizontal surface the patient is lying on, is minimized. This friction is encountered while the cushion is being slid under the lying patient, which determines the amount of horizontal force required to achieve the sliding.

The minimization may be achieved by providing the cushion with at least one of five characteristics, the first of which is a minimized thickness of the cushion in deflated state, for instance accomplished by dematerialization. In this way, the deformations of the objects in between which the cushion is slid in order to allow for its introduction are minimal, such that the forces on the cushion resulting therefrom counteracting the sliding are minimal as well. The second is a minimized the weight of the cushion, for instance implemented by dematerialization and making up of parts by materials with minimal density. The contribution of the weight of the cushion to the friction between its bottom surface and the horizontal surface it is slid over is so minimized. The third is a minimized surface area of the elastic surfaces, e.g. through minimized longitudinal and lateral extensions thereof, and the fourth is a minimized surface roughness of the elastic surfaces, e.g. applied in the form of the provision of a smooth coating on top. Both decrease the contact area of the interfaces to a minimum, thereby minimizing the generation of frictional forces. The fifth characteristic is a maximal flatness of the elastic surfaces, such that the formation of creases, and consequent required corrective movements, is prevented as much as possible, e.g. through a tight span thereof, and minimal variations in thickness of the cushion.

When the system is not being used in the operating room in an operation to rotate a patient, it is in function of the course of the total of activities in the space to have the system stored.

Preferably, this storage is realized on a location that is always the same, and is well visible, in order for the workers in the room to be aware of its presence, and of its location, which works both in favor of the lifetime of the system, as the risk for accidental damage by passing persons or equipment being moved around, and the speed of transportation from and to the location where the medical protocol takes place, as its fetching is eased and can be performed in a routine way.

In further preference, the storage is accomplished by having the system attached to a fixed object in the room, in a way that takes up minimal space, and is out of the (path)way, in order not to hinder other activities or be in the way of other equipment in the room and reduce the risk for accidental damage while it is stored. More preferably, the fixed storage also allows for the attachment and detachment of the system in a convenient way, in particular by having its location be easily accessible, requiring minimal effort to manually position the system at, and by allowing for attachment and detachment that requires a simple, and easy to remember operation, that can be performed in a routine way.

In a proposed system, it further comprises a mounting assembly, which is adapted to mount or store, e.g. suspended along a wall, the deflated cushion at a fixed location, e.g. in a surgery room.

The present invention further proposes a method for sideway rotating a patient from a supine position on a first surface, into a prone position on a second, juxtaposed to the first, and vice versa.

Preferably, the method is particularly suitable for rotating the body of a patient lying on its back on the top surface of the mattress of a transportable nursing bed in the operating room, onto the operating table in the face down position required for medical protocols on the neck or spine. More preferably, in the part of the rotation that requires most effort when performed manually, the body is supported by the system according to the invention.

In the proposed method, a system according to any of the proposed systems in the present invention is provided, which is being used to support the body of the patient while it is being rotated up to a predetermined angle with the horizontal surface. In particular, the body is rotated around the rotation axis from a first position in which it is lying on a first horizontal surface, e.g. a bed, in supine position, into a second position in which the body is lying in a stable, supine position, at an angle relative to the first horizontal surface. The following steps (a) to (c) are included.

(a) The sliding of the cushion in its deflated state in between the body of the patient lying on the first horizontal surface and the back surface of the body, which is in its first position upon commencing the sliding. Herein the cushion acts as according to the characterizing part of the invention, namely a unitary, semi-rigid, portable board. The sliding operation is for example accomplished while the cushion is being pushed towards the rotation axis at one of its edges, in particular the edge opposite to the longitudinal edge that is being positioned most near to the rotation axis, by a health care worker.

(b) The inflation of the cushion, so that it assumes the wedge shape, and supports the body while it rotates around the rotation axis in the intended direction. By the rotation the angle of the body with the first horizontal surface is being increased, which is done until the body reaches its second position.

(c) The stopping the inflation of the cushion.

According to the first object of the current invention, the method reduces the manpower required to sideway rotate a lying patient, while according to the second object, it reduces the required time to perform the operation. The angle of the body with the horizontal surface in the second position of the body, up to which the patient is rotated in step (b), represents a compromise between these two objectives as, as outlined before, the part of the bodyweight that has to be displaced vertically by human muscle power to have it hinge over the rotation axis of the body, decreases as the angle of the body with the horizontal surface increases. The required support decreases by 50% in the first 30°, and by another 20%, 17%, 10% and 3% for each further increase of the rotation angle by 15°. The contribution of the method of the current invention to the amount of manpower saved for achieving the rotation by having the proposed system of the invention provide the vertical support, decreases accordingly with the rotation angle in step (b) of the method.

On the other hand, when the patient is rotated by inflation of the cushion, the amount of air that needs to be inflated progressively increases with the rotation angle of the patient to be accomplished, and so does the time required to achieve the second position of the patient to complete step (b).

Preferably therefore, the method provides a good compromise between the range of angles over which the body of a patient is supported by the system of the current invention in step (b), and the volume to be inflated, and thus the amount of air that is required therefore. In this way the method can be most effective in terms of the amount of manual effort saved relative to the time necessary for the inflation.

In a most preferred execution of the method, the body is supported by the system of the invention during its rotation from the first position over a range of angles up to between 45°, which, as explained earlier, corresponds to a 70% reduction of the part of the bodyweight to be supported relative to a horizontal position, and 75°, corresponding to 97% reduction.

In a further proposed method, the second position is further specified in that the angle of the body with the first horizontal surface therein is between 45° and 75°.

Prior to sideway rotating patients from the nursing bed onto the operating table, the generally wheeled nursing bed is placed immediately next to the operating table, so that the operating table is lateral from the patient at the intended side of its body over which it is rotated. The body of the patient is to be rotated by 180° from its first position in order to have it positioned onto the operating table in prone position.

Preferably therefore, with the patient in second position, the method provides in the remainder of a full rotation of 180° being performed, in particular, manually. Most preferably, the method is particularly suitable for the patient to be rotated onto a surface other than the first.

In a proposed method, the body of the patient is manually rotated around the rotation axis from its second position into a third position after step (c) has been finished. In this third position the body is lying face down on a second horizontal surface that supports the bodyweight. Herein, the second surface can be the top surface of an operating table. The horizontal surfaces are defined to be juxtaposed, in a way that the second horizontal surface is located laterally from the body of the patient at the side proximal to the rotation axis. Two additional steps are included, namely, (d) and (e).

(d) The rotation of the body over the rotation axis while manual force is being exerted thereon, such that the angle of the body with the first horizontal surface is being increased. This automatically entails the angle thereof with the second horizontal surface simultaneously being decreased by the same rate, which is done until it reaches a prone position on the second horizontal surface.

(e) The stopping the manual rotation of the body, such that it assumes its third position.

For certain medical protocols, possibly other than spinal surgery, for instance nursing protocols which may be outside the operating room, it is necessary to perform a full, 180° rotation of a body onto the same surface. For instance, in which the patient remains to lie on the same mattress of a nursing bed. Preferably, therefore the method therefore suits this purpose as well.

In a further proposed method, the second horizontal surface is an extension of the first horizontal surface, e.g. the left half of a mattress of which the right half forms the first horizontal surface.

After medical protocols on the operating table have been finished, generally the body of the patient needs to be rotated from lying face down on the operating table.

Preferably, therefore the method is particularly suitable for rotating the body of a patient lying in a prone position on the top surface of the operating table, onto the nursing bed it was on prior to the protocol. More preferably, in the part of the rotation that requires most effort when performed manually, the body is supported by the system according to the invention.

In a proposed method, a system according to any of the proposed systems in the present invention is provided, which is being used to support the body of the patient while it is being rotated up to a predetermined angle with the horizontal surface. In particular, the body is rotated around the rotation axis from a fourth position in which it is lying on a first horizontal surface, e.g. an operating table, in prone position, into a fifth position in which the body is lying in a stable, prone position, at an angle relative to the first horizontal surface. The following steps (a) to (c) are included.

(a) The sliding of the cushion in its deflated state in between the body of the patient lying on the first horizontal surface and the back surface of the body, which is in its fourth position upon commencing the sliding. Herein the cushion acts as according to the characterizing part of the invention, namely a unitary, semi-rigid, portable board. The sliding operation is for example accomplished while the cushion is being pushed towards the rotation axis at one of its edges, in particular the edge opposite to the longitudinal edge that is being positioned most near to the rotation axis, by a health care worker.

(b) The inflation of the cushion, so that it assumes the wedge shape, and supports the body while it rotates around the rotation axis in the intended direction. By the rotation the angle of the body with the first horizontal surface is being increased, which is done until the body reaches its fifth position.

(c) The stopping the inflation of the cushion.

Prior to sideway rotating patients from the operating table back onto the nursing bed, the latter is, like before the protocol, placed immediately next to the operating table, so that the operating table is lateral from the patient at the intended side of its body over which it is rotated. The body of the patient is to be rotated by 180° from its fourth position in order to have it positioned back onto the nursing bed in supine position.

Preferably therefore, with the patient in fourth position, the method provides in the remainder of a full rotation of 180° being performed, in particular, manually. Most preferably, the method is particularly suitable for the patient to be rotated onto a surface other than the first.

In a proposed method, the body of the patient is manually rotated around the rotation axis from its fifth position into a sixth position after step (c) has been finished. In this sixth position the body is lying on its back on a second horizontal surface that supports the bodyweight. Herein, the second surface can be the top surface of a bed.

Before the rotation operation is performed, the cushion is generally not at the location of the medical procedure—and stored at a remote storage location. In order for the system to be positioned such that step (a) can be commenced, therefore, transportation of the system from its storage location to this position is required.

Preferably therefore, the method provides in such transportation to be performed.

In a further proposed method, it includes the transportation of the cushion in its deflated state from a remote storage location to a position above or on the first horizontal surface, laterally from the body which is already lying on this surface, followed by the sliding step (a).

The present invention also relates to an air inflatable cushion for use in rotating the body of a patient around a rotation axis, which body is lying on a horizontal surface, e.g. a bed, having posterior support points that are formed by the points on the posterior surface thereof that are located under the hips and shoulder blades, which rotation axis is defined by the hip joint and shoulder joint at a common lateral side of the body of the patient, wherein the air inflatable cushion has two elastic exterior surfaces, e.g. of stretch material, which are preferably mutually spaced apart by spacer material in deflated state of the cushion, and are circumferentially joined together to form multiple edges, extending over their common circumference, wherein one of said two elastic surfaces of said cushion forms the top surface, and the other one forms the bottom surface, said cushion comprising an inflatable volume and having a deflated state, wherein the two elastic surfaces are substantially parallel, such that the cushion has a flat shape, and wherein the elastic surfaces have dimensions such that when the body of the patient is lying on the top elastic surface in supine position prior to rotation, said top elastic surface provides support of the posterior support points of the body of the patient, wherein a longitudinal axis of said cushion extends parallel to the medial axis of the body, and a lateral axis extends parallel to the lateral axis of the body, said cushion further having an inflated state, wherein the two elastic surfaces bulge away from each other, such that inflation of the cushion causes the cushion to assume a wedge shape thereby rotating the body around said rotation axis, wherein said cushion is embodied as a unitary, semi-rigid, portable board when in its deflated state, which enables the sliding of the deflated cushion in between the body of the patient and said horizontal surface, on which said body is lying in supine position, until its posterior support points are being supported by the cushion at its top elastic surface, said deflated cushion preferably having a rigidity so as to allow for the exertion of a pushing force on one of its multiple edges during the sliding of the cushion in between the body of the patient and said horizontal surface.

The present invention also relates to an air inflatable cushion for use in rotating the body of a patient around a rotation axis, which body is lying on a horizontal surface, e.g. a bed, having posterior support points that are formed by the points on the posterior surface thereof that are located under the hips and shoulder blades, which rotation axis is defined by the hip joint and shoulder joint at a common lateral side of the body of the patient, wherein the air inflatable cushion has two elastic exterior surfaces, e.g. of stretch material, which are mutually spaced apart, and circumferentially joined together to form multiple edges, extending over their common circumference, wherein one of said two elastic surfaces of said cushion forms the top surface, and the other one forms the bottom surface, wherein one or more layers of spacer material and/or spacer elements are provided in the interior of said cushion between the two elastic exterior surfaces, said cushion comprising an inflatable volume and having a deflated state, wherein the two elastic surfaces are substantially parallel spaced apart by said one or more layers of spacer material and/or spacer elements, such that the cushion has a flat shape, said cushion further having an inflated state, wherein the two elastic surfaces bulge away from each other, such that inflation of the cushion causes the cushion to assume a wedge shape thereby rotating the body around said rotation axis, wherein said cushion is embodied as a unitary, semi-rigid, portable board when in its deflated state, which enables the sliding of the deflated cushion in between the body of the patient and said horizontal surface, on which said body is lying in supine position, until its posterior support points are being supported by the cushion at its top elastic surface, said deflated cushion preferably having a rigidity so as to allow for the exertion of a pushing force on one of its multiple edges during the sliding of the cushion in between the body of the patient and said horizontal surface.

The present invention also relates to a patient rotation system for rotating the body of a patient comprises an air inflatable cushion having two elastic exterior surfaces, e.g. of stretch material, wherein one of said two elastic surfaces of said cushion forms the top surface, and the other one forms the bottom surface. In deflated state the cushion has a flat shape and in inflated state the two elastic surfaces bulge away from each other, such that inflation of the cushion causes the cushion to assume a wedge shape thereby rotating the body around said rotation axis. The cushion is embodied as a unitary, semi-rigid, portable board when in its deflated state, which enables the sliding of the deflated cushion in between the body of the patient and a horizontal surface, on which the body is lying in supine position, until its posterior support points are being supported by the cushion at its top elastic surface.

The present invention also relates to the use of such an air inflatable cushion in rotating the body of a patient around a rotation axis.

A second aspect of the present invention relates to an air inflatable cushion for use in rotating the body of a patient around a rotation axis, wherein the cushion has a top and bottom elastic exterior surface, e.g. of stretch material, which are preferably mutually spaced apart by a spacer material in deflated state of the cushion, and circumferentially joined together, wherein said cushion comprises an inflatable volume and has a deflated state, wherein the two elastic exterior surfaces are substantially parallel, such that the cushion has a flat shape, said cushion further having an inflated state, wherein the elastic surfaces bulge away from each other, such that inflation of the cushion causes the cushion to assume a wedge shape thereby facilitating rotating the body around said rotation axis, wherein said inflatable volume has an upper portion adapted to support a thoracic and shoulder region of the body, a central portion adapted to support the abdominal region of the body, and a lower portion adapted to the pelvic region of the body, e.g. said inflatable volume being a single inflatable volume forming said upper, central, and lower portions, wherein—in inflated state—said upper and lower portions each having a greater cross-section in a lateral plane than said central portion of the inflatable volume adapted to support said abdominal area.

The air inflatable cushion of the second aspect of the invention may comprises one or more of the features discussed herein with reference to the first aspect of the invention.

The second aspect of the invention also relates to the use of such an air inflatable cushion in rotating the body of a patient around a rotation axis.

A third aspect of the invention relates to an air inflatable cushion for use in rotating the body of a patient around a rotation axis, which body is lying on a horizontal surface, e.g. a bed, having posterior support points that are formed by the points on the posterior surface thereof that are located under the hips and shoulder blades, which rotation axis is defined by the hip joint and shoulder joint at a common lateral side of the body of the patient, wherein the air inflatable cushion has two elastic exterior surfaces, e.g. of stretch material, which are preferably mutually spaced apart by spacer material in deflated state of the cushion, and circumferentially joined together to form multiple edges, extending over their common circumference, wherein one of said two elastic surfaces of said cushion forms the top surface, and the other one forms the bottom surface, said cushion comprising an inflatable volume and having a deflated state, wherein the two elastic surfaces are substantially parallel, such that the cushion has a flat shape, and wherein the elastic surfaces have dimensions such that when the body of the patient is lying on the top elastic surface in supine position prior to rotation, said top elastic surface provides support of the posterior support points of the body of the patient, wherein a longitudinal axis of said cushion extends parallel to the medial axis of the body, and a lateral axis extends parallel to the lateral axis of the body, said cushion further having an inflated state, wherein the two elastic surfaces bulge away from each other, such that inflation of the cushion causes the cushion to assume a wedge shape thereby rotating the body around said rotation axis, wherein said inflatable volume has an upper portion adapted to support a thoracic and shoulder region of the body, a central portion adapted to support the abdominal region of the body, and a lower portion adapted to the pelvic region of the body, wherein—seen in plan view onto the cushion—along at least one longitudinal edge of the cushion each of said upper, central, and lower portions of the inflatable volume defines a section of a turning edge, wherein said turning edge section of the central portion is indented or offset towards a center line of the cushion relative to said turning edge sections of said upper and lower portions of the inflatable volume.

The air inflatable cushion of the third aspect of the invention may comprises one or more of the features discussed herein with reference to the first and/or second aspect of the invention.

The third aspect of the invention also relates to the use of such an air inflatable cushion in rotating the body of a patient around a rotation axis.

BRIEF DESCRIPTION OF THE FIGURES

The invention will now be described with reference to the appended drawings. In the drawings:

FIG. 1 shows an embodiment of a patient rotation system 1 according to the invention.

DETAILED DESCRIPTION

The system 1 comprises an air inflatable cushion 2 having two elastic exterior surfaces 3*a*, 3*b*, e.g. of air impermeable stretch material. The elastic surfaces are mutually spaced apart, and circumferentially joined together to form multiple edges 4*a*-4*e*, extending over their common circumference 5, such that said elastic surfaces enclose an inflatable volume. One of said two elastic surfaces 3*a*, 3*b* of said cushion 2 forms the top surface 3*a*, and the other one forms the bottom surface 3*b*.

The cushion 2 is shown in its deflated state, such that the top elastic surface 3*a* is parallel to the bottom elastic surface 3*b*, so that the cushion 2 has a flat shape.

Figure 2A:
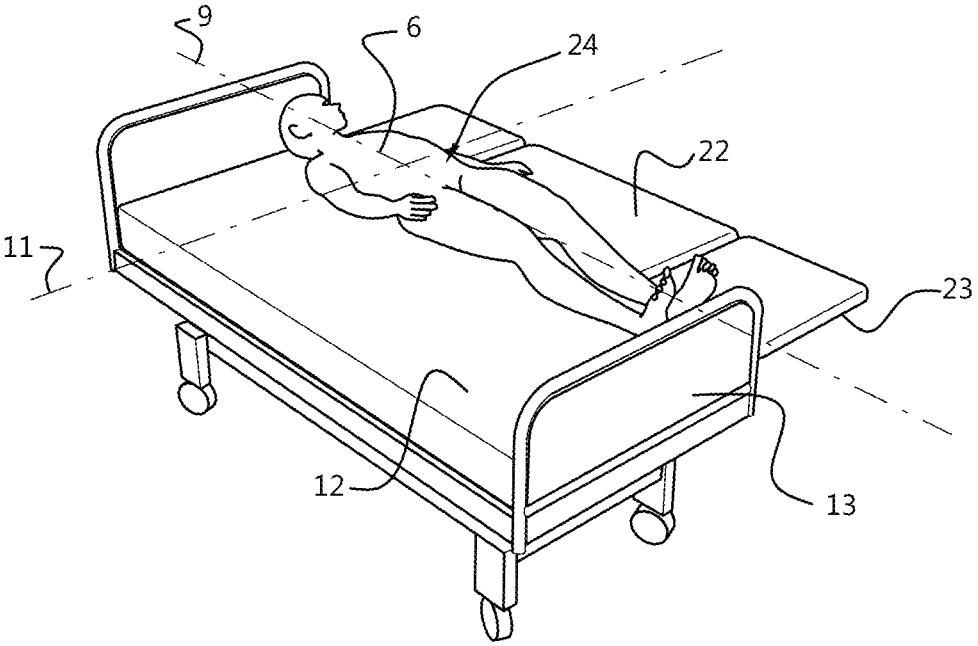
FIG. 2A shows in perspective top view the body of the patient in the first position on the mattress of a wheeled nursing bed, that is, lying in a supine position on its top surface, an operating table placed immediately next thereto.

FIG. 2A shows a body 6 lying on a horizontal surface 12, namely, the mattress of a nursing bed 13. The body 6 has posterior support points 7*a*-7*d*, indicated in FIG. 2D, that are formed by the points on the posterior surface 14 thereof, located posteriorly from the hips and shoulder blades.

Figure 2B:
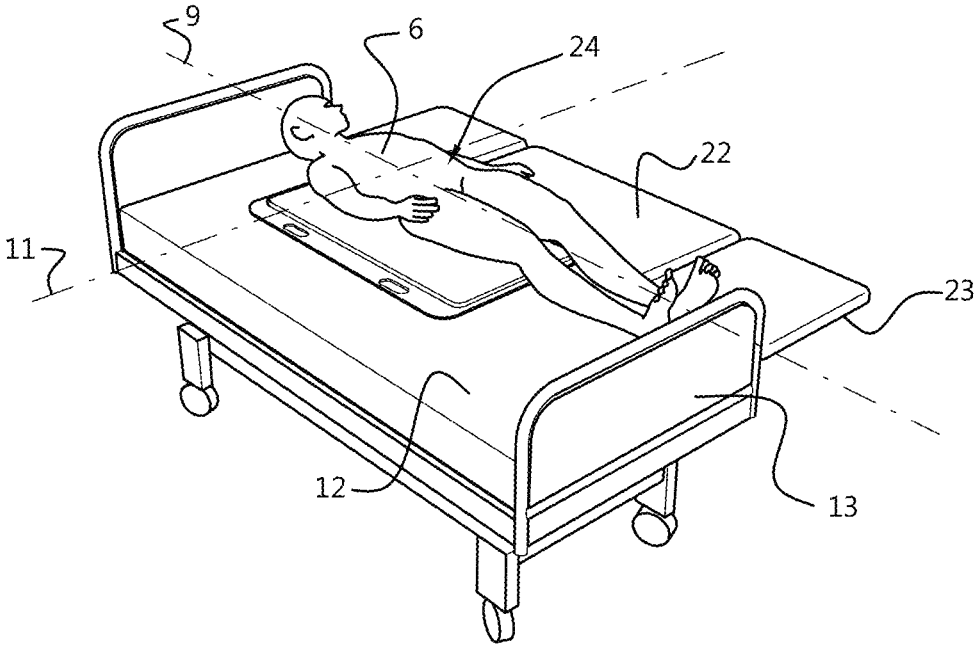
FIG. 2B shows the setting of FIG. 2A in the same view, with in addition the system of FIG. 1 in deflated state being positioned underneath the body, which is lying thereon in supine position.
Figure 2C:
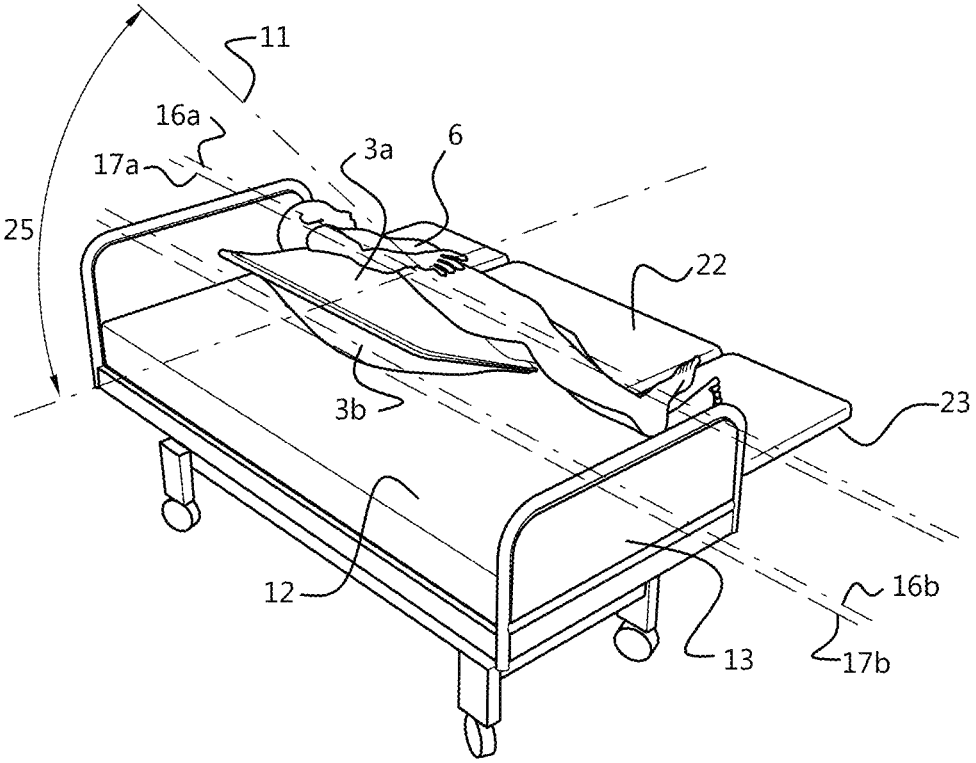
FIG. 2C shows the setting of FIG. 2B in the same view, advanced therefrom in that the body is now in the second position, that is, at an angle with the surface of the mattress and being supported by the cushion in inflated state.
Figure 2D:
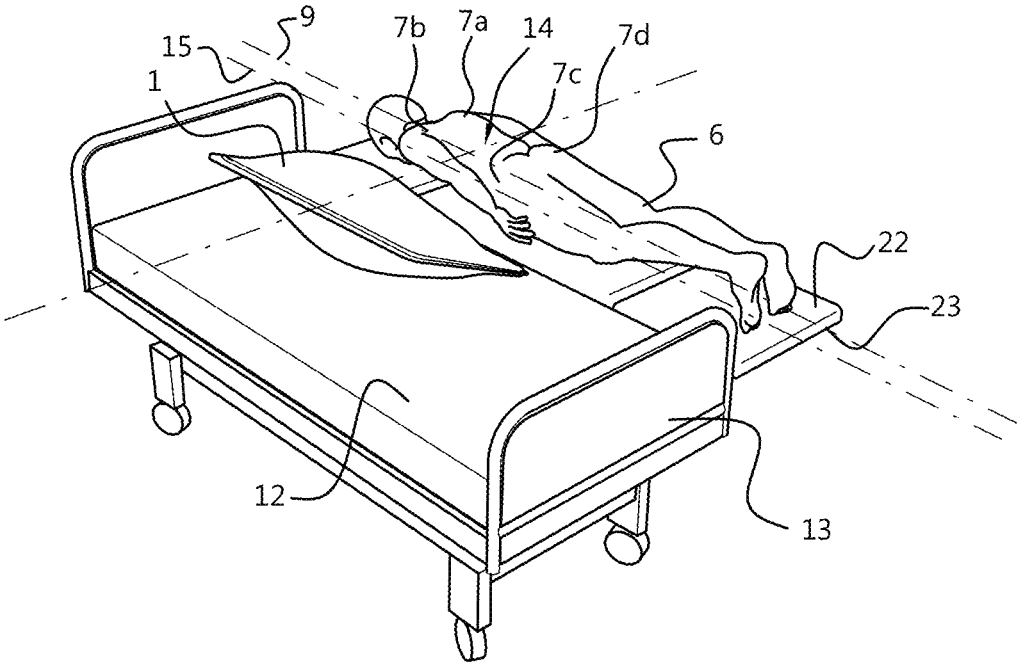
FIG. 2D shows the setting of FIG. 2C in the same view, advanced therefrom in that the body is now in the third position, that is, lying in a prone position on the operating table, the cushion still being supported on the mattress of the nursing bed in its inflated state.

As illustrated in FIG. 2C, the elastic surfaces 3*a*, 3*b* of the embodiment of system 1 have dimensions such that when the body of the patient 6 is lying on the top elastic surface 3*a* in supine position prior to rotation, said top elastic surface 3*a* provides support of the posterior support points 7*a*-7*d* of the body of the patient 6; the support points being indicated in FIG. 2D. When positioned under the patient prior to rotation, as illustrated in FIGS. 2C and 2D a longitudinal axis 8 of the cushion 2 of the shown system 1 extends parallel to the medial axis 9 of the body 6, and a lateral axis 10 extends parallel to the lateral axis 11 of the body 6.

Figure 2E:
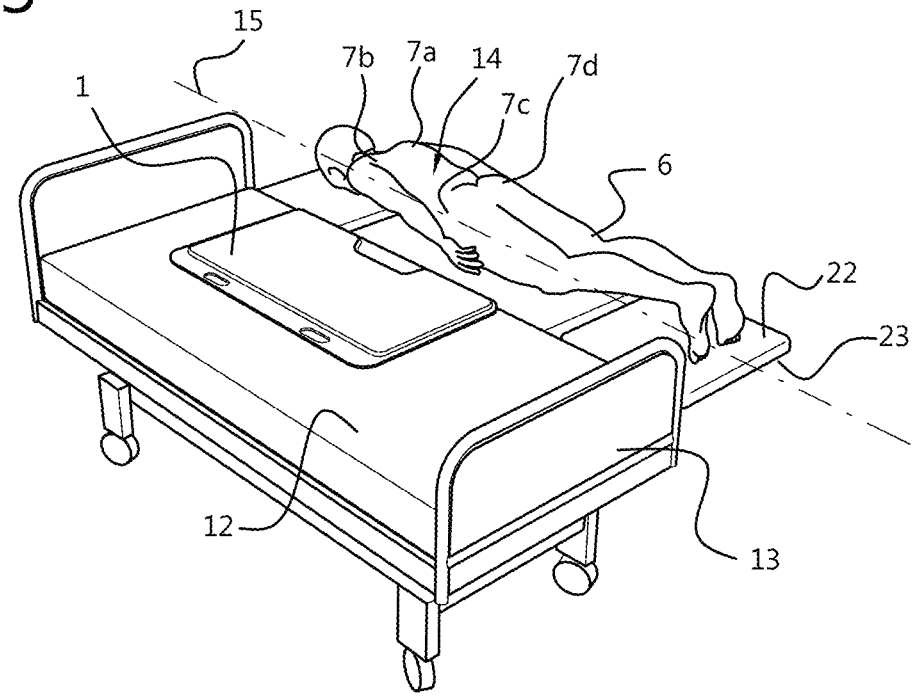
FIG. 2E shows the setting of FIG. 2D in the same view, advanced therefrom in that the cushion is now in its deflated state.

FIGS. 2D and 2E show the cushion 2 of the shown system 1 in an inflated state. As illustrated, in this state the two elastic surfaces 3*a*, 3*b* bulge away from each other, such that inflation of the cushion 2 causes the cushion 2 to assume a wedge shape. Thereby, it rotates the body 6 around the rotation axis 15. This rotation axis 15 is defined by the hip and shoulder joint at a common lateral side of the body of the patient 6.

Figure 1:
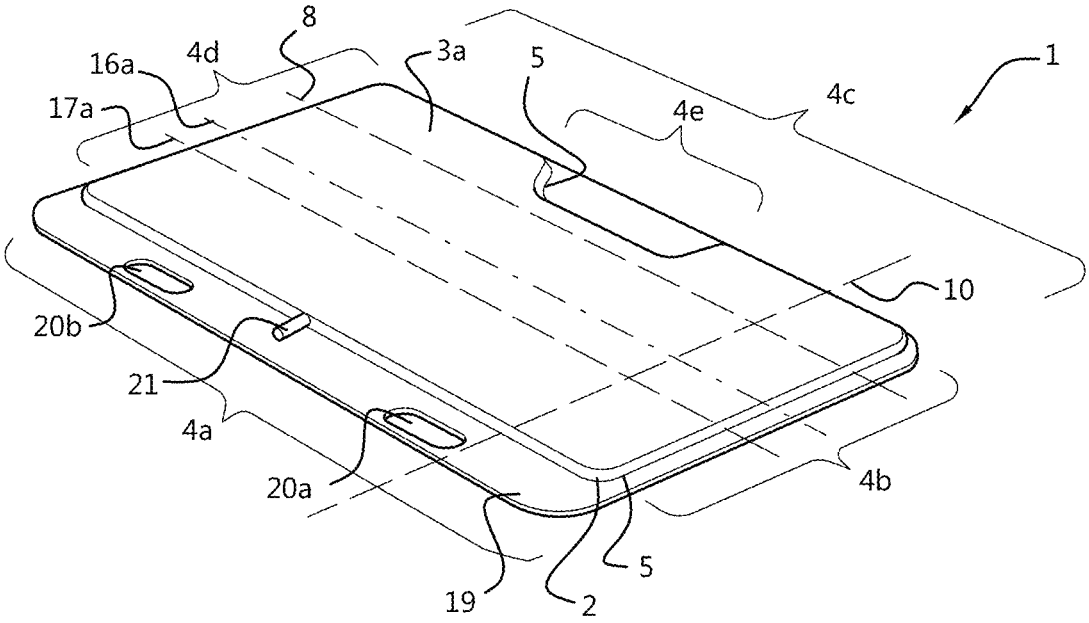
FIG. 1 shows a perspective top view of an exemplary embodiment of a system according to the invention, the cushion being in deflated state.

The cushion 2 is embodied as a unitary, semi-rigid, portable board when in its deflated state, shown in FIGS. 1, 2B and 2E which enables the sliding of the deflated cushion 2 in between the body of the patient 6 and the horizontal surface 12. That is, the advancement from the setting shown in FIG. 2A, in which the body 6 is lying in supine position on the horizontal surface 12, to that in FIG. 2B, in which its posterior support points 7*a*-7*d* are being supported by the cushion 2 at its top elastic surface 3*a*. As preferred, the deflated cushion 2 of the embodiment has a rigidity so as to allow for the exertion of a pushing force on one of its multiple edges 4*a*-4*e* during the sliding of the cushion 2 in between the body of the patient 6 and the horizontal surface 12.

In embodiments, the one or more semi-rigidising elements, e.g. spacer material, or rigid frame, when present, of the cushion are more rigid than the elastic surfaces.

In the embodiment of the system 1 shown in FIGS. 1 and 2B-2E, each of the elastic surfaces has a center line 16*a*, 16*b* that extends in the longitudinal direction of the cushion 2, such that it evenly divides the lateral distance between the longitudinally extending edges 4*a*, 4*c*. The elastic surfaces 3*a*, 3*b* moreover each have a midline 17*a*, 17*b* that extends in the longitudinal direction of the cushion 2, such that it evenly divides the surface area thereby defined. The shape of at least one of the elastic surfaces 3*a*, 3*b* of the cushion 2 is laterally asymmetric, such that when the cushion 2 is in deflated state, the midline of each elastic surface is laterally shifted with respect to the respective center line. This causes the rotation of the body 6 resulting from inflating the cushion 2 being directed around the rotation axis 15.

As shown in FIG. 1 and FIG. 2E, in the shown system 1 the lateral asymmetry of at least one of the elastic surfaces 3*a*, 3*b* of the cushion 2 is embodied by having a turning edge 4*c* of the cushion 2 comprise an indent 4*e*, which is directed towards the center line of the elastic surfaces.

Figure 3:
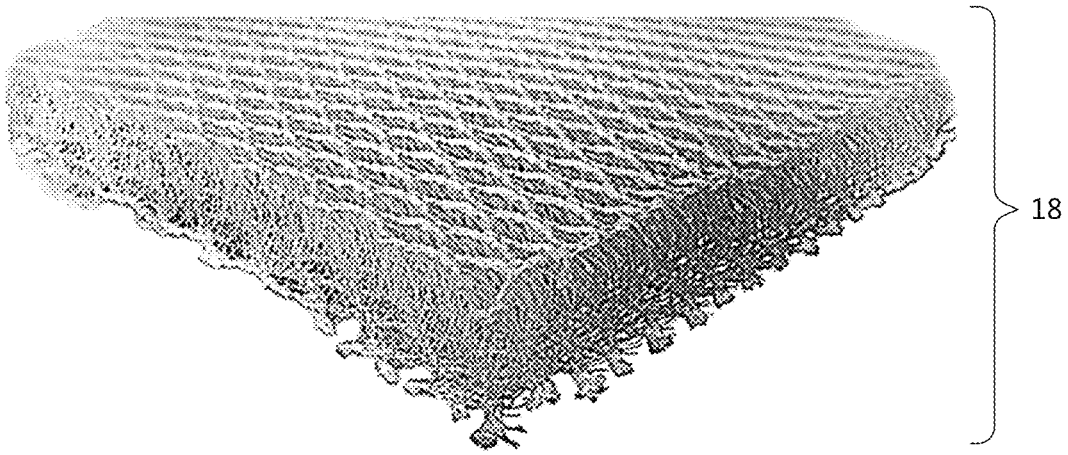
FIG. 3 shows a close up view of an example layer of spacer material.

In deflated state, the spacing between the two elastic exterior surfaces 3*a*, 3*b* of the shown system 1 is defined by one or more layers of a spacer material 18 in the interior of said cushion 2. An example of its embodiment is shown in FIG. 3, in which the spacer material 18 is, as preferred, made out of elastically stretchable spacer fabric. The spacer material 18 contributes to the semi-rigidity of the portable board when in deflated state. In the shown embodiment, the spacer material 18 is elastically compressible in the direction perpendicular to the plane of the elastic surfaces 3*a*, 3*b*, that is, over the thickness of the cushion 2. This contributes to the cushion 2 being compressible, and that pressure resulting from the weight of the body of the patient 6 being supported by the cushion 2, like shown in FIGS. 2B and 2C, is distributed over a contact area in between the top surface 3*a* of the cushion 2 and the posterior surface 14 of the body of the patient 6.

In the embodiment of FIGS. 1 and 2B-2E, a first layer of spacer material 18 is connected to the top elastic surface 3*a* and second layer of spacer material 18 to bottom elastic surface 3*b*. The layers of spacer material 18 are, as preferred, each made out of the elastically stretchable spacer fabric shown in FIG. 3, allowing them to stretch together with the top elastic surface 3*a* and the bottom elastic surface 3*b*, particularly during inflation, when advancing from the setting in FIG. 2B to 2C. The layers of spacer material 18 are, as preferred, configured to cause the tendency for the two elastic surfaces 3*a*, 3*b* of the cushion 2 to move towards each other. Thereby it creates the tendency for the cushion 2 to return to its deflated state upon inflation, thereby advancing from the setting in FIG. 2D to 2E. The spacer material 18 of the embodiment allows the cushion 2 to self-deflate immediately after inflation is stopped.

The embodiment of the system 1 illustrated in FIGS. 1 and 2B-2E is embodied to be maximally inflated and deflated at least 50 times before failure. Herein, failure is considered any loss of shape and/or self-deflating property, so that the 50 times of maximally in- and deflating of the cushion 2 is possible before undue loss of elastic property of any spacer material 18, or layer thereof.

The cushion 2 of the shown system 1 further comprises a rigid or semi-rigid frame 19, that forms an outer contour of the cushion 2 in the plane of the elastic surfaces 3*a*, 3*b*, and thereby forms its outer edges 4*a*-4*e*. The frame contributes to the semi-rigidity of the cushion 2 in deflated state, thereby enhancing the sliding of the deflated cushion 2 in between the body of the patient 6 and the horizontal surface 12. That is, while advancing from the setting of FIG. 2A, in which the body 6 is lying in supine position on the horizontal surface 12, to the setting in FIG. 2B, in which its posterior support points 7*a*-7*d* are being supported by the cushion 2 at its top elastic surface 3*a*.

In the shown system 1, the frame 19 is provided with two handles 20*a*, 20*b*, in the form of two hand grip openings with an I shape that fits a hand, to form handles along a longitudinal edge 4*a* of the cushion 2. This longitudinal edge 4*a* is located opposite to the edge 4*c* that is these two edges 4*a*, 4*c* located most proximal to the rotation axis when positioned under the patient as shown in FIGS. 2B and 2C. The handles 20*a*, 20*b* are mutually spaced apart by between 0.5 m and 0.8 m. In this way, the handles 20*a*, 20*b* for example facilitate convenient manual exertion of a pushing force on the cushion 2 by a single user while sliding the cushion 2 in between the body of the patient 6 and the horizontal surface 12. That is, while advancing from the setting of FIG. 2A in which the body of the patient 6 is lying in supine position on the horizontal surface 12, to the setting of FIG. 2B in which its posterior support points 7*a*-7*d* are being supported by the cushion 2 at its top elastic surface 3*a*. Moreover, the handles 20*a*, 20*b* of the shown system 1 for example contribute to convenient manual positioning of the cushion 2 by a single user of the system 1, during transport and handling of the cushion 2.

The shown system 1 further comprises a pressure relief valve 21, e.g. which avoids overpressurization of the cushion 2. According to an exemplary embodiment, it automatically releases any amount of air that would result in the air pressure within the inflatable volume exceeding a predetermined value that corresponds to the air pressure in the inflatable volume when the cushion 2 is in its maximum inflated state. In this way, the pressure relief valve 21 prevents the cushion 2 from being overinflated.

In the shown system 1, the cushion is dimensioned such that when in maximum inflated state, illustrated in FIG. 2B, it supports the body of the patient 6 while it is at an angle of between 45° to 75° with the horizontal surface 12.

Furthermore, the inflatable volume of the cushion 2 of the shown system 1 in inflated state is minimized by minimizing the ratio between the inflatable volume and the surface area of the elastic surfaces 3*a*, 3*b* of the cushion 2 in inflated state, according to an exemplary embodiment by minimizing the length of the multiple edges 4*a*-4*e*, and by minimizing the surface area of the elastic surfaces 3*a*, 3*b*, by minimizing their longitudinal and lateral extension.

In the shown system 1 moreover the surface friction between the top elastic surface 3*a* of the cushion with the posterior surface 14 of the body of the patient 6, and between the bottom elastic surface 3*b* of the cushion 2 with the horizontal surface 12 is minimized. This friction is encountered while the cushion 2 is being slid in between the body 6 and said horizontal surface 12, thus by advancing from the setting in FIG. 2A to that in FIG. 2B. This is accomplished by minimizing the thickness of the cushion 2 in deflated state, namely by dematerialization, and by minimizing the weight of the cushion 2, namely by dematerialization and making up of parts by materials with minimal density, and by minimizing the surface area of the elastic surfaces 3*a*, 3*b*, namely by minimizing their longitudinal and lateral extension, and by minimizing the surface roughness of the elastic surfaces 3*a*, 3*b*, namely by providing them with a smooth coating, and by maximizing the flatness of the elastic surfaces 3*a*, 3*b*, namely by providing a tight span thereof, and minimizing variations in thickness of the cushion 2.

Figure 4:
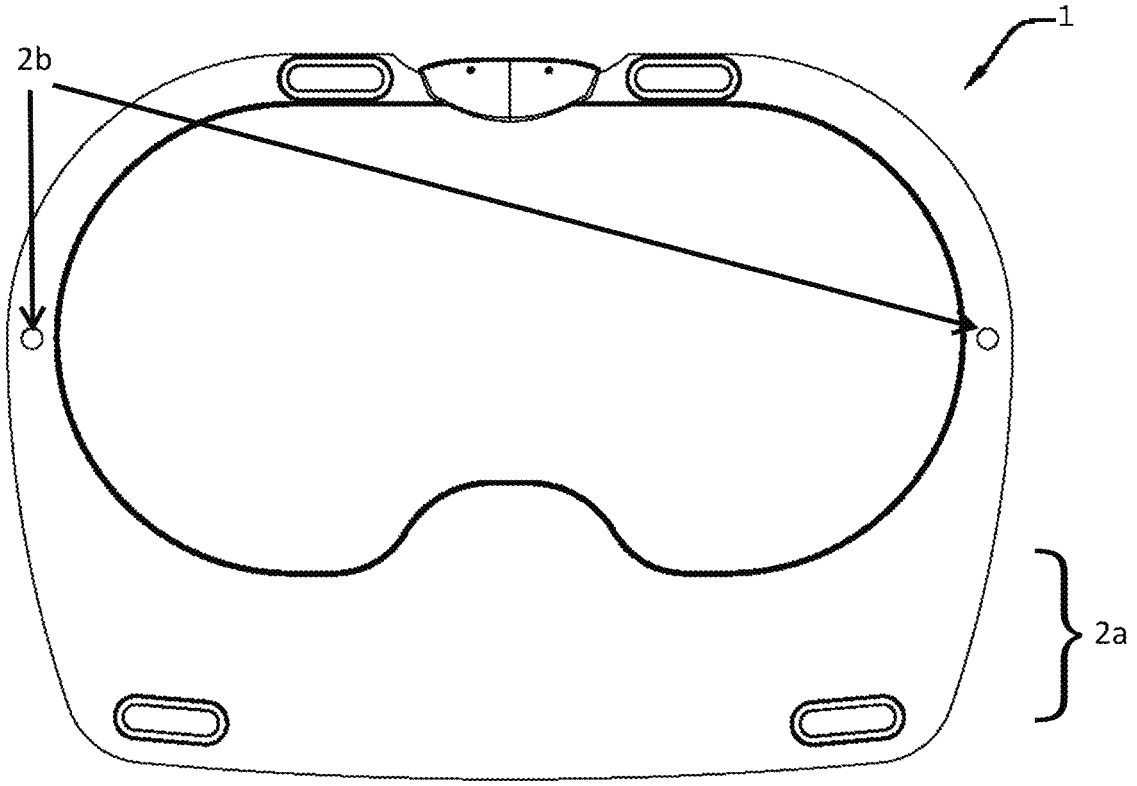
FIG. 4 shows an embodiment of an exemplary embodiment, the cushion being in deflated state.

As shown in FIG. 4, system 1 further comprises a side flap 2*a* connected to the cushion at a lateral side thereof, which is adapted to support the hip joint and/or the shoulder joint which define(s) the rotation axis at said lateral side, while the body of the patient is being rotated around the rotation axis and/or while lying on the cushion in its inflated state at an angle relative to the horizontal. In particular, the side flap is provided at the lateral side of the indent 4*e* and extends from the edge 4*c* in a lateral direction. The system 1 shown in FIG. 4 further comprises one or more mounting elements 2*b*, which are adapted to mount or store, e.g. suspended along a wall, the deflated cushion at a fixed location, e.g. in a surgery room. Here, the one or more mounting elements 2*b* thereto comprise two bores, by means of which the system 1 may be suspended from one or two protruding wall mountings, e.g. nail(s), pin(s) or screw(s).

The advancement between steps in a possible execution of the method according to the invention are shown in FIGS. 2A to 2C, for rotating the body of a patient 6 around the rotation axis 15, making use of a patient rotation system according to the shown system 1 of the system according the invention.

In FIG. 2A, the first position in the execution of the method is illustrated in which the body 6 is lying on a first horizontal surface 12, namely the top surface of the mattress of a wheeled nursing bed 13, in supine position, the posterior support points 7*a*-7*d* being supported thereby. FIG. 2C illustrates the second position in which the body 6 is lying in a stable, supine position at an angle 25 relative to the first horizontal surface 12.

The advancement from the setting of FIG. 2A to that in FIG. 2C is accomplished by executing at least following steps according to the method of the invention, in which the advancement from the setting illustrated in FIG. 2A to that in FIG. 2B is accomplished by step (a), and from the setting in FIG. 2B to that in FIG. 2C by step (b) and possibly (c).

(a) Sliding the cushion 2 in its deflated state in between the body of the patient 6 lying on the first horizontal surface 12, and the posterior surface 14 of the body 6, which is in its first position, as shown in FIG. 2A. Herein, the cushion 2 acts as a unitary, semi-rigid, portable board. The sliding for example involves manually exerting a horizontal pushing force on one of its edges 4*a*, so as to push the cushion 2 underneath the body 6.

(b) Inflating the cushion 2 so that it assumes a wedge shape, thereby rotating the body 6 around the rotation axis 15. Therewith the angle 25 of the body 6 with the first horizontal surface 12 is being increased, until the body 6 is in its second position, depicted in FIG. 2C.

(c) Stopping the inflation of the cushion 2.

In the execution of the method, the second position depicted in FIG. 2C is as preferred, further specified in that the angle 25 of the body 6 with the first horizontal surface 12 therein is between 45° and 75°.

The further advancement between steps in a possible execution of the method according to the invention is shown in FIGS. 2C to 2E, wherein the body of the patient is manually rotated around the rotation axis 15 from its second position, shown in FIG. 2C, into a third position, shown in 2D after step (c) has been finished. In the execution of the method, in the third position the body 6 is lying in a prone position on a second horizontal surface 22, namely the top surface of an operating table 23. The anterior surface 24 of the body 6 is therein being supported by the second horizontal surface 22. As illustrated in FIGS. 2B to 2E, the second horizontal surface 22 and the first horizontal surface 12 are juxtaposed, the second horizontal surface 22 being located laterally from the body of the patient 6 at the side proximal to the rotation axis 15.

The advancement from the setting of FIG. 2C to that in FIG. 2E is accomplished by executing at least following steps according to the method of the invention, in which the advancement from the setting of FIG. 2C to that in FIG. 2D is accomplished by step (d) and (e). The advancement from the setting in FIG. 2D to that in FIG. 2E can take place after, or simultaneous to (e).

(d) Rotating the body 6 over the rotation axis 15 while exerting manual force thereon, such that the angle thereof with the first horizontal surface 12 is being increased, and the angle thereof with the second horizontal surface 22 is simultaneously being decreased by the same rate, until the body 6 is in a prone position on the second horizontal surface 22.

(e) Stopping the manual rotation of the body 6, such that it assumes its third position, depicted in FIG. 2E.

The invention claimed is:

1. A patient rotation system configured for rotating the body of a patient lying on a horizontal surface around a rotation axis, which body has posterior support points that are formed by the points on the posterior surface thereof that are located under the hips and shoulder blades, which rotation axis is defined by the hip joint and shoulder joint at a common lateral side of the body of the patient, the system comprising:

an air inflatable cushion having two elastic exterior surfaces circumferentially joined together to form multiple edges, extending over their common circumference, wherein one of said two elastic surfaces of said cushion forms a top surface, and the other one forms a bottom surface, said air inflatable cushion comprising an inflatable volume and having a deflated state, wherein the two elastic surfaces are substantially parallel, such that the air inflatable cushion has a flat shape, and wherein the elastic surfaces have dimensions such that when the body of the patient is lying on the top elastic surface in supine position prior to rotation, said top elastic surface is configured to provide support of the posterior support points of the body of the patient, wherein a longitudinal axis of said air inflatable cushion extends parallel to a medial axis of the body, and a lateral axis of said air inflatable cushion extends parallel to a lateral axis of the body, said air inflatable cushion further having an inflated state, wherein the two elastic surfaces bulge away from each other, such that inflation of the air inflatable cushion causes the air inflatable cushion to assume a wedge shape configured for rotating the body around said rotation axis, and wherein the system comprises one or more semi-rigidising elements, and wherein said air inflatable cushion is embodied as a unitary, semi-rigid, portable board when in its deflated state, which semi-rigidity of the board is sufficient to enable the sliding of the deflated cushion in between the body of the patient and said horizontal surface, on which said body is lying in supine position, until its posterior support points are being supported by the air inflatable cushion at its top elastic surface, wherein, in said deflated state, a spacing between the two elastic exterior surfaces is defined by one or more layers and/or elements of a spacer material in the interior of said cushion, which spacer material contributes to said semi-rigidity of said portable board-like cushion when in deflated state, wherein a first layer of spacer material is connected to the top elastic surface and a second layer of spacer material to the bottom elastic surface, and wherein said layers are each of elastically stretchable spacer fabric allowing said layers to stretch together with said top elastic surface and bottom elastic surface, wherein said layers of elastically stretchable spacer fabric are configured to cause the tendency for the two elastic surfaces of the cushion to move towards each other, thereby creating the tendency for the cushion to return to its deflated state upon inflation.

2. The system according to claim 1, wherein said inflatable volume has an upper portion adapted to support a thoracic and shoulder region of the body, a central portion adapted to support the abdominal region of the body, and a lower portion adapted to the pelvic region of the body.

3. The system according to claim 2, wherein the spacer material is elastically compressible in the direction perpendicular to the plane of the elastic surfaces, such that the cushion is compressible and that pressure resulting from the weight of the body of the patient being supported by the cushion is distributed over a contact area in between the top surface of the cushion and the posterior surface of the body of the patient.

4. The system according to claim 1, wherein said inflatable volume has an upper portion adapted to support a thoracic and shoulder region of the body, a central portion adapted to support the abdominal region of the body, and a lower portion adapted to the pelvic region of the body, wherein—seen in plan view onto the cushion—along at least one longitudinal edge of the cushion each of said upper, central, and lower portions of the inflatable volume defines a section of a turning edge, wherein said turning edge section of the central portion is indented or offset towards a center line of the cushion relative to said turning edge sections of said upper and lower portions of the inflatable volume.

5. The system according to claim 1, in which the cushion is embodied to be maximally inflated and deflated at least 50 times before failure.

6. The system according to claim 1, wherein the cushion further comprises a rigid or semi-rigid frame that forms an outer contour of the cushion in the plane of the elastic surfaces, which frame contributes to the semi-rigidity of the cushion in deflated state, thereby enhancing the sliding of the deflated cushion in between the body of the patient and said horizontal surface, on which said body is lying in supine position, until its posterior support points are being supported by the cushion at its top elastic surface.

7. The system according to claim 6, wherein the frame is provided with one or more handles to facilitate convenient manual exertion of a pushing force on the cushion by a single user while sliding the cushion in between the body of the patient and the horizontal surface on which the body of the patient is lying in supine position, and/or convenient manual positioning thereof by a single user of the system, during transport and handling of the cushion.

8. The system according to any of the preceding claims, the cushion further comprising a pressure relief valve such that the pressure relief valve prevents the cushion from being overinflated.

9. The system according to claim 1, in which the cushion is dimensioned such that when in maximum inflated state, it supports the body of the patient while it is at an angle of between 45° and 75° with respect to the horizontal surface.

10. The system according to claim 1, wherein the inflatable volume of the cushion in inflated state is minimized by at least minimizing the ratio between the inflatable volume and the surface area of the elastic surfaces of the cushion in inflated state and/or by minimizing the surface area of the elastic surfaces.

11. The system according to claim 1, wherein surface friction between the top elastic surface of the cushion with the posterior surface of the body of the patient, and between the bottom elastic surface of the cushion with the horizontal surface, encountered while the cushion is being slid in between said body and said horizontal surface, is minimized by one or more of minimizing the thickness of the cushion in deflated state, minimizing the weight of the cushion, minimizing the surface area of the elastic surfaces, minimizing the surface roughness of the elastic surfaces, or by maximizing the flatness of the elastic surfaces.

12. The system according to claim 1, the system further comprising a side flap connected to the cushion at a lateral side thereof, which is adapted to support the hip joint and/or the shoulder joint which define(s) the rotation axis at said lateral side, while the body of the patient is being rotated around the rotation axis and/or while lying on the cushion in its inflated state at an angle relative to the horizontal.

13. The system according to claim 1, further comprising a mounting element, which is adapted to mount or store the deflated cushion at a fixed location.

14. A method for rotating the body of a patient around the rotation axis, from a first position in which said body is lying on a first horizontal surface, the posterior support points being supported thereby, into a second position in which the body is lying in a stable, supine position at an angle relative to the first horizontal surface, in which method use is made of a patient rotation system according to claim 1, which method comprises the following steps:

(a) sliding the cushion in its deflated state wherein said cushion acts as a unitary, semi-rigid, portable board, in between the body of the patient lying on said first horizontal surface and the posterior surface of the body, which is in its first position, (b) inflating the cushion so that it assumes a wedge shape thereby rotating the body around a rotation axis, the angle of said body with the first horizontal surface being increased, until said body is in its second position; and (c) stopping the inflation of the cushion.

15. The method according to claim 14, wherein the second position is further specified in that the angle of the body with the first horizontal surface therein is between 45° and 75°.

16. The method according to claim 14, in which the body of the patient is manually rotated around the rotation axis from its second position into a third position after step (c) has been finished, in which third position the body is lying in a prone position on a second horizontal surface, the anterior surface of the body being supported by the second horizontal surface, which second horizontal surface and said first horizontal surface are juxtaposed, the second horizontal surface being located laterally from the body of the patient at the side proximal to the rotation axis, said method further comprising the following steps:

(d) rotating the body over the rotation axis while exerting manual force thereon, such that the angle thereof with the first horizontal surface is being increased, and the angle thereof with the second horizontal surface is simultaneously being decreased by the same rate, until it is in a prone position on the second horizontal surface, and (e) stopping the manual rotation of the body, such that it assumes its third position.

17. The method according to claim 16, wherein the second horizontal surface is an extension of the first horizontal surface.

18. The method according to any of claim 14, which includes transportation of the cushion in its deflated state from a remote storage location to a position above or on the first horizontal surface, laterally from the body of the patient already lying on said first horizontal surface, followed by said sliding step.

19. A method for rotating the body of a patient around the rotation axis, in which method use is made of a patient rotation system according to claim 1, in which method the system is applied for rotating the body of the patient around the rotation axis, from a first position in which said body is lying on a first horizontal surface, in prone position, the anterior surface being supported thereby, into a second position in which the body is lying in a stable, prone position at an angle from the first horizontal surface, which method comprises the following steps:

(a) sliding the cushion in its deflated state wherein said cushion acts as a unitary, semi-rigid, portable board, in between the body of the patient lying on said first horizontal surface and the anterior surface of the body, which is in its first position, (b) inflating the cushion so that it assumes a wedge shape thereby rotating the body around a rotation axis, the angle of said body with the first horizontal surface being increased, until said body is in its second position; and (c) stopping the inflation of the cushion.

20. The method according to claim 19, wherein the body of the patient is manually rotated from its second position into a third position after step (c) has been finished, in which the body is lying in a supine position on a second horizontal surface, the posterior surface of the body being supported by the second horizontal surface.

* * * * *